US007461531B2

(12) United States Patent
Hellgren

(10) Patent No.: US 7,461,531 B2
(45) **Date of Patent: *Dec. 9, 2008**

(54) PRESS PLANT AND A METHOD AND USE FOR IT WITH A PRESSURE CELL AND A DIVISIBLE TRAY

(75) Inventor: Keijo Hellgren, Västerås (SE)

(73) Assignee: Avure Technologies AB, Vasteras (SE)

( * ) Notice: Subject to any disclaimer, the term of this patent is extended or adjusted under 35 U.S.C. 154(b) by 599 days.

This patent is subject to a terminal disclaimer.

(21) Appl. No.: 10/415,244

(22) PCT Filed: Nov. 23, 2001

(86) PCT No.: PCT/SE01/02594

§ 371 (c)(1),
(2), (4) Date: Oct. 21, 2003

(87) PCT Pub. No.: WO02/43888

PCT Pub. Date: Jun. 6, 2002

(65) Prior Publication Data

US 2004/0050263 A1 Mar. 18, 2004

(30) Foreign Application Priority Data

Nov. 28, 2000 (SE) ..... 0004370

(51) Int. Cl.
*B21D 22/10* (2006.01)

(52) U.S. Cl. ..... 72/63; 72/60; 72/455

(58) Field of Classification Search ..... 72/54, 72/56, 57, 60, 63, 419, 420, 350, 446, 455, 72/709, 351, 424, 453.01, 453.13, 465.1, 72/466, 466.7, 466.8; 29/421.1
See application file for complete search history.

(56) References Cited

U.S. PATENT DOCUMENTS

| | | | | | |
|---|---|---|---|---|---|
| 2,354,005 | A | * | 7/1944 | Flowers | 72/351 |
| 2,771,850 | A | | 11/1956 | Wheelon | 113/44 |
| 3,033,143 | A | * | 5/1962 | Grankowski | 72/63 |
| 3,531,966 | A | * | 10/1970 | Pappas | 72/63 |
| 3,545,241 | A | * | 12/1970 | Grankowski et al. | 72/63 |
| 3,875,778 | A | * | 4/1975 | Hellgren | 72/63 |
| 3,938,361 | A | * | 2/1976 | Claesson et al. | 72/63 |
| 4,080,139 | A | * | 3/1978 | Hellgren | 425/389 |
| 4,105,388 | A | * | 8/1978 | Hellgren | 425/389 |

(Continued)

FOREIGN PATENT DOCUMENTS

CH 232717 9/1944

(Continued)

*Primary Examiner*—Edward Tolan
(74) *Attorney, Agent, or Firm*—Harness, Dickey & Pierce, PLC

(57) ABSTRACT

A press plant includes a press of pressure cell type, into which a tray device, which defines a space intended to receive a workpiece and, optionally, a forming tool, is insertable. The tray device comprises a tray plate and a tray frame. The tray frame is adapted to independently withstand, at least in certain portions, loads applied during the pressing operation. The tray device is divisible into at least an upper part and a lower part. The invention also relates to a method and use of a tray device in a press plant.

24 Claims, 8 Drawing Sheets

U.S. PATENT DOCUMENTS

| | | | | |
|---|---|---|---|---|
| 4,112,724 | A | 9/1978 | Claesson et al. | 72/63 |
| 4,573,335 | A * | 3/1986 | Persson | 72/63 |
| 4,658,618 | A * | 4/1987 | Hellgren | 72/63 |
| 4,676,086 | A * | 6/1987 | Hellgren | 72/63 |
| 4,693,103 | A * | 9/1987 | Hellgren | 72/63 |
| 4,711,111 | A | 12/1987 | Hellgren | 72/63 |
| 4,773,816 | A * | 9/1988 | Fuller et al. | 414/771 |
| 5,752,406 | A * | 5/1998 | Dearing et al. | 72/389.1 |
| 6,029,486 | A * | 2/2000 | Haraga et al. | 72/57 |
| 6,233,989 | B1 * | 5/2001 | Blinstrubas | 72/55 |
| 6,365,210 | B1 * | 4/2002 | Schaible et al. | 426/94 |
| 7,150,171 | B2 * | 12/2006 | Hellgren | 72/63 |
| 7,155,949 | B2 * | 1/2007 | Hellgren | 72/63 |

FOREIGN PATENT DOCUMENTS

| | | |
|---|---|---|
| SE | 338 756 | 9/1971 |
| SE | 407 526 | 4/1979 |
| SE | 451 975 | 11/1987 |
| SE | 452 436 | 11/1987 |

* cited by examiner

PRESS PLANT AND A METHOD AND USE FOR IT WITH A PRESSURE CELL AND A DIVISIBLE TRAY

FIELD OF THE INVENTION

The present invention relates to a press plant with a press of pressure cell type as well as a method and use for making the operation of a press plant comprising a press of pressure cell type more efficient.

BACKGROUND ART

A press of pressure cell type generally comprises a force-absorbing press body which defines a press chamber. In the upper part of the press chamber, a press plate and a diaphragm of rubber or another resilient material are arranged, which together form a pressure cell. The pressure cell communicates with a source of pressure and expands when a pressure medium is supplied. In the lower part of the press chamber, a structural support or a tray is arranged, which comprises a bottom plate having a tray frame. The tray supports a forming tool, a workpiece, and, generally, a mat of rubber or another resilient material covering the forming tool and the workpiece.

Presses of pressure cell type are used, among other things, when forming sheet-shaped blanks or workpieces, for example sheets of steel or aluminium, to short-series products within the aircraft industry and the motor industry. The sheet is placed in the press in such a manner that one of its sides faces a forming tool. The resilient diaphragm is arranged on the other side of the sheet. A closed space between the diaphragm and the press plate located above the diaphragm constitutes the pressure cell and this space is filled during the forming process with a pressure medium. By pumping additional pressure medium into the pressure cell, the pressure is increased in the pressure cell and the resilient diaphragm is pressed during stretching against the sheet which, in its turn, is formed round or in the forming tool. When the sheet completely fits to the forming tool, the pressure in the pressure cell is released and the diaphragm is removed, after which the formed component can be taken out of the press.

Another field in which presses of pressure cell type are used is wood compaction, when a workpiece of wood is exposed to high pressure, either in a forming tool or on its own. Reasons for compacting wood are, for example, that it is desirable to increase the hardness of the wood, decrease the moisture content or to obtain a phase in pressure impregnation.

In traditional press plants comprising presses of pressure cell type, use is made of a forged tray, the short sides of which, at least, are made in one piece with a tray bottom. The short sides and the radial transition to the tray bottom must be dimensioned to withstand high working pressures. This means that, in many cases, the tray will be thick and heavy and, thus, difficult to handle.

Another variant of a press plant with a press of pressure cell type is known from SE 452 436. A large annular support is provided around a press body to absorb loads induced during a pressing operation on a tray which is introduced into the press. The handling of such a stand is relatively difficult and time-consuming.

SUMMARY OF THE INVENTION

The object of the present invention is to provide more efficient operation of a press plant.

This and other objects, which will be evident from the following description, are achieved by means of a press plant, use and a method, which have the features indicated in the appended claims.

The present invention suggests a completely new form of tray configuration and use of a tray allowing a significantly more efficient operation of a press plant and a rational handling thereof.

In the following description, a "tray device" according to the present invention means a device designed to contain a forming tool and/or a workpiece. Thus, in the traditional meaning, it may comprise walls or a tray frame and a tray or bottom plate. However, it should also comprise an essentially annular configuration intended to be detachably arranged on a separate bottom plate; the tray device may, for example, include a single tray frame resting on a bottom plate associated with the press body, or on a bottom plate which is movable into or out of the press.

In the present application, terms describing position and direction, such as "vertical" and "horizontal", are used. In this application, these terms are defined with respect to the tray device. Thus, the periphery of the tray device runs horizontally, whereas its height extends vertically. It should also be understood that, in the present application, "over/upwards/above" and "under/downwards/below" are defined with respect to a main direction of pressing, i.e. so that a press plate is located above a diaphragm which, in its turn, is located above a tray or bottom plate, which means that vertically is defined as perpendicular to the press plate and horizontally as parallel to the press plate. Thus, a tray plane is a horizontal plane. The above-mentioned definitions have been indicated for the sake of clarity, since the press of pressure cell type can be inclined in different manners, and due to this fact the relative directions can vary.

According to one aspect of the invention, a press plant with a press of pressure cell type is provided. The press of pressure cell type comprises a force-absorbing press body enclosing a press chamber into which a tray device which defines a space intended to receive a workpiece and, optionally, a forming tool is insertable. The tray device is divisible into at least an upper part and a lower part and comprises a tray plate and a tray frame which is adapted to independently withstand, at least in certain portions, loads applied during the pressing operation.

Thus, the present invention is based on the understanding that the operation of a press plant can be made extremely time-efficient and easy to handle by exploiting the divisibility of a tray device comprising a tray frame, which does not require a force-absorbing device arranged externally, for example outside the end wall of the press, but which, at least partially, independently withstands loads applied thereon during the pressing operation. Consequently, the ends of the tray frame, which are usually exposed to great forces, do not need any additional support, and they do not have to be made in one piece with the tray bottom or the tray plate.

By using a tray frame which does not require any external supporting elements at the end walls or short sides of the press, the number of steps in the pressing process is minimized, in particular as regards the insertion, removal or change of workpiece and/or forming tool, if any. For this purpose, the tray frame is preferably adapted to independently withstand loads applied during the pressing operation along at least the direction of the main axis of the press chamber, i.e. the direction in which the tray device is usually brought into or out of the press chamber.

The divisibility of the tray device means that a workpiece can be rapidly and easily introduced therein or removed therefrom. It also means that a forming tool can be easily arranged. Also from the point of view of cleaning, the divisibility is advantageous, among other things because spaces that traditionally were difficult to access now become easily accessible.

According to another aspect of the invention, a method for arranging a workpiece in a press of pressure cell type in a press plant is provided, said press of pressure cell type comprising a force-absorbing press body which encloses a press chamber into which a divisible tray device which defines a space intended to receive a workpiece and a forming tool is insertable, the workpiece being arranged in such manner that it is retained in a fixed position when an upper and a lower tray part have been joined.

The use, in a press plant, of a tray device which is annularly divisible into an upper frame part and a lower frame part has been found to be particularly advantageous and is also one aspect of the invention. The upper and lower frame parts together form a tray frame in the tray device. Accordingly, this divisibility means that only one frame part has to be removed to gain access to a workpiece and/or a forming tool. The knowledge that only one part of the tray frame has to be lifted or removed to get access to a workpiece or a forming tool, and not the entire tray frame, is important in terms of power. It means that only the force required to divide the tray device will be used.

According to an advantageous embodiment of the invention, retention of a workpiece, such as a sheet-metal blank, in a fixed position is achieved when an upper frame part and a lower frame part have been joined to form a tray frame. Consequently, a variant of this is that the workpiece is retained in position and clamped between the frame parts when these have been joined. Another variant is that the workpiece is retained in a fixed position with the aid of means provided on or adjacent to the frame parts, one means being adapted, for example, to be moved together with a frame part.

In the basic configuration of a divisible tray frame, the upper and lower frame parts are joined, i.e. there is essentially no air gap between them, and during the actual forming of a workpiece the tray device has said basic configuration. The possibility of not using this basic configuration, when necessary, by separating the surfaces of the frame parts facing one another, allows the tray device to be used efficiently without losing the retaining action on the workpiece. The annularly divisible tray frame replaces, by an upper and a lower tray part, traditional fixing means, such as bolted joints or screw joints, for attaching a workpiece, in particular a sheet-metal blank, and time-consuming operations, such as attaching a workpiece by screwing or unscrewing a workpiece, can thus be avoided.

After the pressing, the workpiece is uncovered by separating the upper and lower frame parts, or at least the surfaces clamping the workpiece, from each other to such an extent that the workpiece can be accessed and removed. The divisibility of the tray device also allows a new workpiece to be applied in a simple manner by arranging the workpiece so that the separated frame parts, when they are brought together, directly or indirectly lock the workpiece.

The invention allows separation of a tray frame, which, at least in its end portions, has the ability to independently withstand loads generated during pressing, from a bottom or tray plate. The tray plate, which together with the tray frame forms a tray device space, could be a fixed part of the press or a removable part which accompanies the tray frame as this is removed from the press. Both alternatives allow insertion of a forming tool and/or a workpiece. Above all, efficient operation of the press and a high throughput are obtained, for example, in the case of wood compaction, where a workpiece of wood can be rapidly inserted into or removed from the tray device after the tray frame has been separated from the tray plate. Obviously, this is a considerable difference compared with prior-art forged trays, in which the ends of the tray frame were made in one piece with the tray bottom or tray plate.

Further advantages of the invention are obtained if the divisibility is used at several levels, for example by providing a tray frame which is divisible in an upper annular and a lower annular frame part and which can be removed from the tray plate. This affords many options and a high degree of freedom of action in connection with the operation of the press plant.

Advantageously, the tray parts are separated outside the press, preferably on a worktable. Following the pressing of a workpiece, for example a sheet-metal blank, in the press chamber, the divisible tray device is removed from the press to a worktable, for example. The tray parts are then separated to uncover the finished workpiece. For practical reasons, the workpiece should advantageously, after separation of the frame parts, remain in contact with the lower tray part, from where it can be easily removed. It is also advantageous, for practical reasons, to arrange a new workpiece directly onto the lower tray part.

One way of separating the tray parts is by vertical displacement. Thus, it is possible to move a tray part or both tray parts, without any rotation, along the direction of their common centre axis so that a space is formed. The space is preferably a gap, the height of which is related to or corresponds to the extension of a finished workpiece in said direction of the centre axis. When the tray device is resting on a worktable outside the press, an advantageous way of achieving a separation by vertical displacement is to lift the upper tray part, while the lower tray part remains in contact with the worktable. The upper tray part can be lifted with the aid of actuating means which are located above said tray part and exert a pulling or lifting force on the upper tray part, as well as actuating means which are located below said tray part, for example adjacent to the worktable, and push up the upper tray part to press it upwards. It will be apparent to a person skilled in the art that a corresponding space can be created by lowering the lower tray part while maintaining the upper tray part in a fixed position, or by simultaneously lowering the lower tray part and raising the upper tray part.

Another way of separating, at least partly, the tray parts and uncovering a workpiece comprises lateral or horizontal displacement of at least one of the tray parts. In this case, there is no substantial vertical displacement.

A further way of separating, at least partly, the tray parts is by providing a flexible connection between one side of the upper tray part and one side of the lower tray part. The divisible tray device is then opened like a hatch, or like a trouser press. Thus, it will be appreciated that the terms 'dividing' and 'separating' cover also this form of parting. The terms dividing and separating are thus used in the sense that the tray parts have opposing surfaces which are removed from one another.

Yet another way of uncovering a machined workpiece is by providing a flexible connection between the tray parts that is such that the tray device is opened by turning at least one tray part horizontally, in which case substantially no vertical displacement occurs.

Different ways of separating the tray parts outside the press have been described above. An alternative way is to separate the tray parts inside the press. This can be achieved, for example, by using an insert which is placed on the bottom of the press and onto which the tray device is applied. When removing the insert from the press, for instance after a finished pressing operation, the tray device is lowered. A sufficient space is then formed in the press chamber above the tray device to allow the upper tray part to be lifted and the finished workpiece to be removed.

The upper and lower tray parts are removed from each other with the aid of actuating means which exert a force on at least one of the tray parts. Such actuating means are, for example, hydraulic pistons, gripping means, ball screws etc. The tray part (or the two tray parts) to be moved by the actuating means are conveniently provided with contact means which interact with the actuating means. The contact means may, for instance, comprise stop surfaces or engagement surfaces, said actuating means abutting against or engaging these surfaces.

The divisible tray device is also advantageous from the point of view of cleaning. Following a completed pressing of a workpiece, not only the workpiece but also all sorts of residual scrap have to be removed from the tray device. In a tray device according to the invention, no scrap will be 'fixed' but will be easily accessible once the upper tray part has been separated from the lower tray part. The tray parts only have to be separated to such an extent that the workpiece can be removed, such as separated by a space in the form of a horizontal gap. When the workpiece has been removed, for instance by means of one or more manipulator arms, suitable suction, rinsing and/or drying devices are introduced into the space between the tray parts. Lubricating devices for lubricating the forming tool and/or workpiece can also be introduced. These devices are suitably designed as some kind of arm. Thus, much time is saved by separating or dividing the tray device into an upper and a lower tray part, which allows the workpiece to be removed and the tray device to be cleaned without further manipulation of the tray parts. Time-consuming actions, such as unscrewing or the like, are thus avoided.

As follows, a major advantage of the invention is the possibility of rapidly changing the workpiece directly outside the press, for example on a worktable. The tray device does not have to be moved away from the worktable (to avoid production standstill) when sheet-metal or scrap is to be removed. Nor does the change of workpiece require much space, since the tray device is not opened more than what is required for the workpiece to be accessible and/or insertable between the tray parts.

Traditionally, use have been made of forged trays, the short sides of the tray being made in one piece with a tray bottom. In those cases, the short sides and the radial transition to the tray bottom have been dimensioned to allow the trays to withstand high working pressures. This has made the trays unnecessarily thick and heavy. The tray device of the invention and, in particular, the tray parts thereof are suitably relatively light, so that the tray device may be easily divided as described above.

To ensure that even a relatively light tray part, especially a tray frame, has the ability to absorb and independently withstand the great forces generated during pressing, the upper and lower tray parts are suitably prestressed by means of prestressing means which induce a compressing prestress acting in planes which are parallel to the tray plane, i.e. essentially horizontal planes. The tray parts comprise an inner edge surface which defines the space in which a forming tool is to be arranged and a workpiece is to be machined. The tray parts also comprise a circumferential edge surface, on which the prestressing means are advantageously arranged. Preferably, the prestressing means comprise at least one prestressing element which is wound round the external edge surface. Thus, the prestressing means are integrated with the tray device.

Compared with a traditional, forged tray, the prestressing means allow a significant reduction of the thickness of the tray device as far as short sides and transition radii are concerned. This means that the inventive tray device allows a greater working depth in relation to prior-art forged trays and also that aspects such as manufacturing and transporting the tray device are improved.

According to an advantageous embodiment of the press plant, the tray device comprises a number of plate-shaped lamellar means which abut against one another. Each lamellar means is annular in shape and provided with a central through hole. The lamellar means which are plate-shaped, i.e. their horizontal extension is greater than their vertical extension, are arranged one above the other in different tray planes or plate planes and they are concentrically arranged relative to the central holes. A workpiece, such as a sheet-metal blank, is intended to be machined in the space formed by the holes in the concentric lamellar means. Thus, the upper tray part comprises at least one lamellar means, and the lower tray part also comprises at least one lamellar means. Advantageously, the tray parts may also comprise several lamellar means, as will be described below.

The tray parts are suitably prestressed in such manner that each lamellar means is individually prestressed. Preferably, this is achieved by arranging a prestressing element on each lamellar means. It has been found particularly advantageous to use, by winding, a prestressing element which is band-shaped and has essentially the same width as the thickness of a lamellar means.

It follows from the above that the invention is also based on the understanding that a tray device will be easier to manufacture and transport, as well as easier to handle during operation of the press plant, by dividing the tray device into several annular parts. Another advantage is that these parts or lamellar means may be assembled to form a tray device at the location where the press is to be used, and may also be individually disassembled to be transported elsewhere or stored.

The divisible tray device suitably comprises lamellar means of the type described above, which are removably arranged on each other. During a pressing operation, the lowermost lamellar means is arranged, preferably detachably, on a bottom plate in the press chamber. A diaphragm support is preferably arranged above the uppermost lamellar means, and a press plate is in turn arranged above the diaphragm support. Together the holes in the lamellar means thus form a space which is defined by the inner wall of the internal lamellar means, the bottom plate and a diaphragm located in the diaphragm support, respectively. One or more lamellar means may be provided between the lowermost lamellar means and the diaphragm support, depending on, for example, the working depth. Alternatively, the tray device comprises only one lamellar means.

Preferably, the divisible tray device is arranged in the press chamber in such manner that the diaphragm support located above the tray device can be lifted in the direction of the press plate. This allows a convenient insertion and removal of the tray device, as will be described below. Actuating means, such as hydraulic pistons, are arranged in a suitable manner to lift the diaphragm support (and, optionally, one or more lamellar means). In its upper portion, the inner diameter of the diaphragm support essentially corresponds to the circumference or diameter of the press plate, which makes it possible to cause the diaphragm support, when lifted, to enclose the press plate. Suitably, the diaphragm support is high enough to enclose the press plate even when it is not lifted, so that a satisfactory seal is obtained during pressing.

Preferably, the diaphragm support is modelled on a lamellar means, which in terms of appearance is essentially similar to the lamellar means of the tray device, and is intended to hold a diaphragm, which with a pressure cell forms the press plate. Since the diaphragm generally is not removed or changed as often as the workpiece, it is an advantage if the diaphragm support does not have to be removed from the press when removing a workpiece or forming tool therefrom.

A significant advantage of the lifting function in the press chamber as described above is that it facilitates the change of workpiece or forming tool. Instead of having to lift a heavy annular stand provided on the outside of the press to a relatively high level in order to access the tray device in the press chamber, it is sufficient to lift the diaphragm support high enough for a gap to appear (which will not be there when a pressing operation is carried out), the underlying lamellar means being easily removable along the direction of the main axis of the press chamber as there is no friction against the diaphragm support. The direction of the main axis of the press chamber lies in a horizontal plane. Alternatively, the diaphragm support and one or more lamellar means are lifted and the lamellar means located underneath is/are removed while the rest remain in the press. The remaining lamellar means can then be lowered (with or without the diaphragm support) with the aid of the actuating means to the bottom of the press chamber, and said lamellar means can be lifted, in a corresponding manner, to their intended position prior to a pressing operation.

When changing the workpiece, at least the lamellar means contained in the upper and lower tray parts is/are removed. The number of lamellar means in a tray part varies depending on the 'height' of the finished workpiece, i.e. its vertical extension. In the case of a relatively flat, machined workpiece, one lamellar means in each tray part may be enough, whereas in the case of a machined workpiece with a relatively great vertical extension, several lamellar means may be appropriate. If, for example, the upper tray part comprises several lamellar means, the lowermost of these is preferably subjected to a force when the workpiece is being changed. Advantageously, this is achieved by hydraulic cylinders adapted to project from the worktable affecting points of engagement provided on said lowermost lamellar means in the upper tray part, said lamellar means and all lamellar means located thereabove being lifted and separated from the underlying lamellar means associated with the lower tray part.

Advantageously, the internal lamellar means are loosely arranged on the bottom plate and on one another. However, some sort of control elements are arranged in order to ensure correct positioning. Due to the fact that the internal structure of the press comprises lamellar means which are loosely arranged on one another, it is possible to remove them easily one by one or several of them at the same time. This great flexibility also means that, during a certain pressing operation, the upper tray part of a certain tray device may contain the majority of the lamellar means, while, during another pressing operation, the lower tray part will contain the majority of the lamellar means. Thus, a lamellar means may be associated with the upper tray part on one occasion and with the lower tray part on another.

The divisibility of the tray device affords several advantages since the lamellar means may be used for several purposes: on the one hand, they may constitute a direct or indirect support for a working tool or forming tool on which, for example, a metal sheet is to be shaped and, on the other, they can support or hold various parts which are active in the press. For instance, a diaphragm which together with the press plate forms a pressure cell can be clamped between two lamellar means or the uppermost lamellar means and the press plate. Alternatively, the diaphragm can rest loosely against a shelf which protrudes from a lamellar means located at the top, which corresponds to the diaphragm support described above. A mat (described in more detail below) which is used to protect the diaphragm and is placed below the same can be fastened between two lamellar means.

Accordingly, owing to the advantageous embodiment including prestressed lamellar means, no external force-absorbing device is required on the short sides of the press chamber. The press construction can therefore be made relatively open by the short sides of the press chamber wall, i.e. the external sides of the lamellar means, being accessible to allow insertion and removal of the internal lamellar means. In the assembled press, preferably some of the internal lamellar means will at the ends of the press protrude from the actual press body.

The lamellar means advantageously used to form a tray device or, at least, a tray frame are essentially oval in shape. According to one embodiment, each annular lamellar means has a wall configuration which defines a central hole, said wall configuration having approximately the shape of a closed 'running track' in a stadium. Thus, the wall configuration consists of two parallel sides which are joined at both ends by an outwardly curved semicircular portion to form a closed track. In certain cases, it may be advantageous for the holes to have an essentially rectangular or square cross section in the horizontal plane. Advantageously, this is achieved by means of filling elements of a resilient material, such as rubber, which are arranged on the inside of the tray device, inside the semicircular portions on the lamellar means arranged on top of each other. The purpose of the filling elements is, inter alia, to serve as an adequate support for a forming tool. If the forming tool is sufficiently large, the filling elements can be omitted. It is also convenient to use filling elements in connection with wood compacting, since a piece of wood has the shape of a rectangular block. The filling elements are also used for absorption and distribution of forces and stress generated during a pressing operation.

During a pressing operation, the tray device of the invention is exposed to an internal overpressure, and because of this the tray device aims at expanding, at high pressures, whereby high tensile stress is generated in the internal periphery of the tray device. Even if the tray frame is adapted to withstand, at least partly independently, loads applied during a pressing operation, it may be desirable, when working under high pressure, to control the deformations in the tray device in the following ways. One way is to provide force transmitting means or force generating means, which are arranged separately from the tray device and exert a force in the horizontal plane on the side portions of the tray frame. However, no such force transmitting means are located at the end portions of the tray frame. Preferably, such force transmitting means are adapted to 'actively' exert one or more radially prestressing and/or radially predeforming forces on the tray device. Alternatively, these forces may be exerted on one or more lamellar means if any such means are included in the tray device. The force transmitting means include, for example, hydraulic pistons or other suitable means having the same function. These means of force transmission allow tensile and compressive stress which arise in the tray device during pressing to be eliminated. Said means may also serve the purpose of counteracting any initial play between the lamellar means and, adjacent thereto, existing side walls in the press chamber.

The lamellar means of the inventive tray device can be given the desired shape by milling or cutting. Different types of cutting are possible, a few examples being water cutting, plasma cutting and flame cutting. Those skilled in the art will realise that this is a considerably simpler process than the forming of the traditional compact tray by forging. It also facilitates to a considerable degree the transport of the lamellar means, which each separately are relatively light, as compared with the transport of prior-art trays. Preferably, the lamellar means are made of hot-rolled steel sheet which subsequently is easily given the desired shape. In the present invention, it has turned out to be suitable to use a sheet thickness of 80-150 mm, preferably 100-120 mm.

Due to the fact that the lamellar means are separate units which, by degrees, together are to form a tray device, manufacture thereof can be accelerated considerably. Thus, various lamellar means blanks can be machined in the respective stations at the same time. A first lamellar means blank can be machined in a certain station and when this lamellar means blank has been moved on to a subsequent station for further machining, a second lamellar means blank can be machined at the same time in said certain station. This parallel managing of different manufacturing steps thus turns out to be very beneficial. It is also distinctly easier to move a relatively thin lamellar means in comparison with a traditional, large tray. Preferably, some stations can process several lamellar means blanks simultaneously.

The lamellar means are easily transported to the location where the press of pressure cell type is intended to be used and assembled in situ. The divided tray structure with integrated prestressing means has been found to work perfectly under typical working pressures (e.g. 1200 bars) for presses of pressure cell type. Instead of making one large and heavy tray, the structure is divided into several plates which each weigh less and thus are more easily handled.

Although the tray device according to the invention is preferably used in a press chamber enclosed by a traditional, forged press body, it has been found to be convenient to make also the press body from force-absorbing lamellar means. This allows the greater part of the press to be manufactured in the same way and the elements forming part thereof to be easily transported to the location of use of the press, where they are assembled.

It is also possible to make each lamellar means from two or more pieces, which are then held together by said winding to form a continuous piece.

In presses of pressure cell type, it is customary to provide the tray with a mat of rubber or another resilient material to protect the diaphragm from wearing too quickly. In this case, during the pressing operation the mat is located under the diaphragm and on top of the workpiece and the forming tool. To remove a finished workpiece the mat, which traditionally has been attached to an end wall block in the tray, has to be unrolled from the workpiece, and to form a new workpiece the mat has to be rolled out. The divisible tray device of the press plant according to the invention allows an additional time-saving measure, namely to attach the mat protecting the diaphragm to the upper tray part. Thus, when the upper tray part is removed from the lower tray part, the mat will also come off and the workpiece will thereby be uncovered, making further measures intended to remove the mat unnecessary.

After a period of use, the mat has to be changed because of wear. If the mat is attached to the upper side of the upper tray part it will be easily accessible. It may even rest relatively loosely on the upper tray part. When the tray part comprising the mat resting loosely thereon is inserted into the press chamber prior to a pressing operation, the mat is suitably locked or clamped between the upper tray part and a structure provided in the upper portion of the press chamber. Such a structure may be, for instance, a lamellar means as described above, for example the lamellar means holding the diaphragm, which remains in the press after the pressing operation has been completed. This type of arrangement thus means that the workpiece and the mat can be changed essentially simultaneously.

DETAILED DESCRIPTION OF THE DRAWINGS

Figure 1:
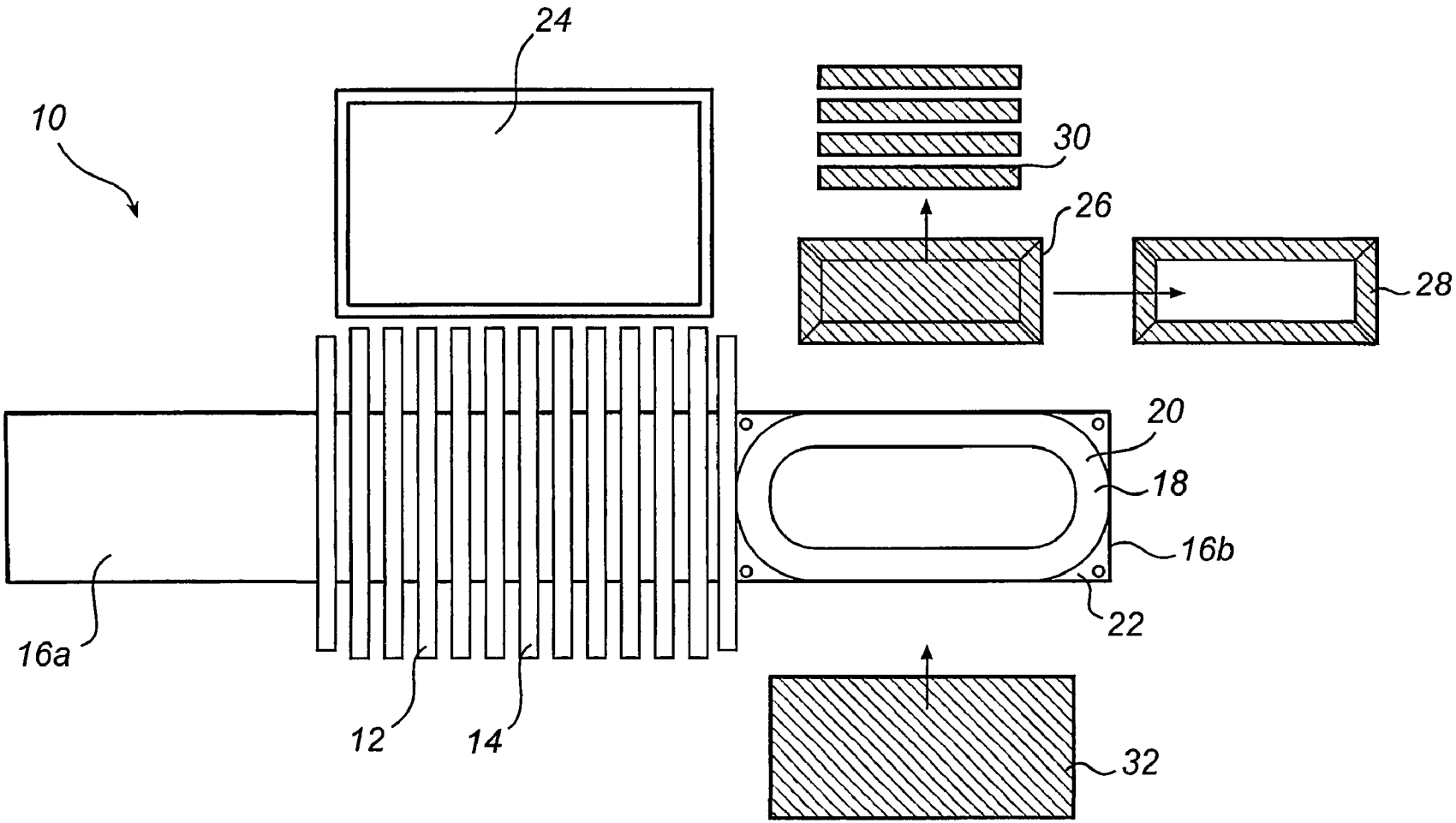
FIG. 1 is a schematic illustration of an embodiment of a press plant according to the invention.

FIG. 1 is a schematic illustration of one embodiment of a press plant 10 according to the invention. The press plant 10 comprises a press 12 of pressure cell type, which in the Figure has a press body made of lamellar means 14. Worktables 16*a*, 16*b* are provided adjacent to the two short sides of the press 12 of pressure cell type. A tray device 18 adapted to hold a workpiece and, if required, a forming tool is provided on the work table 16*b* to the right of the press 12. The tray device 18 comprises an elongate, annular tray frame 20, which is arranged on a substantially quadrangular tray plate 22. The tray device 18 is insertable into the press 12 of pressure cell type, the pressing process being controlled by means of a control device 24 which comprises hydraulic means, inter alia to regulate the operation of the pressure cell. A machined workpiece, here shown as a metal sheet 26, is removed from the tray device 18 once this has been placed on the worktable 16*b* outside the press 12. The inventive divisibility of the tray device 18 allows easy removal of the metal sheet 26 by simply lifting an upper part of the tray device 18, thereby getting access to the metal sheet 26. Thus, the sheet 26 is removed directly on the worktable 16*b*, and scrap 28 is then removed before the finished plate 30 is stored.

When the finished plate has been removed, a new sheet metal blank 32 can be introduced into the tray device 18 and the upper tray part lowered. The lifting and lowering of the upper part of the tray device 18 is advantageously controlled by means of the control device 24 and actuators, such as hydraulic pistons, connected thereto.

While the change of workpiece described above is being carried out, another tray device comprising a workpiece is arranged in the press 12 for forming said workpiece. When the forming has been completed, the tray device is removed (in order to change the workpiece) and placed on the worktable 16a to the left of the press, while the prepared tray device 18 is introduced into the press from the right side. This implies rational handling of the press plant 10, since the number of steps to be carried out is small.

Figure 2:
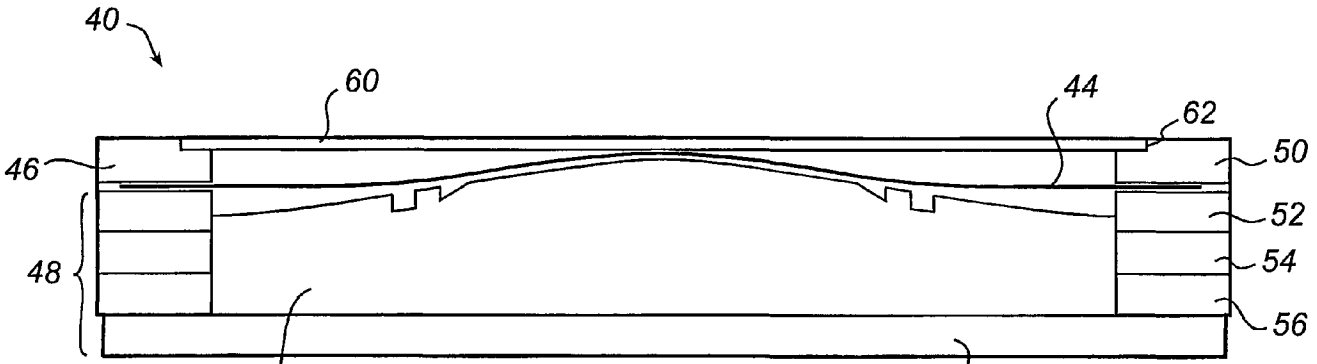
FIG. 2 is a side view of a tray device in its basic configuration for use in a press plant according to one embodiment of the invention.

FIG. 2 is a side view, in cross section, of a basic configuration of a tray device 40 for use in a press plant according to one embodiment of the invention. The tray device 40 is annular and defines a central space. A forming tool 42 on which a metal sheet 44 is to be shaped is arranged in the space. The tray device 40 comprises an upper tray part 46 and a lower tray part 48 (shown more clearly in FIG. 3). In the basic configuration, the upper tray part 46 and the lower tray part 48 have been brought together so that there is essentially no air gap between them. However, when a pressing operation is to be carried out, the metal sheet 44 is clamped between said tray parts 46, 48 and extends above the forming tool 42 across the defined space.

In the tray device 40 shown in FIG. 2, the upper tray part 46 comprises one lamellar means 50, whereas the lower tray part 48 comprises three lamellar means 52, 54, 56 and one bottom or tray plate 58, the lowermost lamellar means 56 and the forming tool 42 being arranged thereon. Lamellar means and variants thereof will be described in more detail in connection with FIGS. 7-10. The tray plate 58 can be brought in and out of a press, for example by means of rollers, in which press the actual forming of the metal sheet takes place. The lowermost lamellar means 56 is preferably detachably arranged on the tray plate 58, but could, as an alternative, be integrated with the tray plate 58 in a non-detachable manner. A mat 60 is superposed on the upper tray part 46 to protect the diaphragm that, during pressing, will be expanded downwards toward the forming tool 42 and press the metal sheet 44 arranged therebetween. The mat 60 is placed on a shelf 62 provided in the uppermost lamellar means 50, i.e. the upper tray part 46, and extends across the space, the forming tool 42 and the metal sheet 44.

Thus, once the tray device 40 has been prepared as shown in FIG. 2, with the forming tool 42 being positioned in the space, the sheet 44 clamped across the forming tool 42 and the protective mat 60 placed on top, the tray device 40 is inserted into the press of pressure cell type. Upon completion of the pressing of the metal sheet 44, the tray device 40 is removed from the press of pressure cell type, following which the upper tray part 46 and the lower tray part 48 are separated. This is illustrated in FIG. 3.

Figure 3:
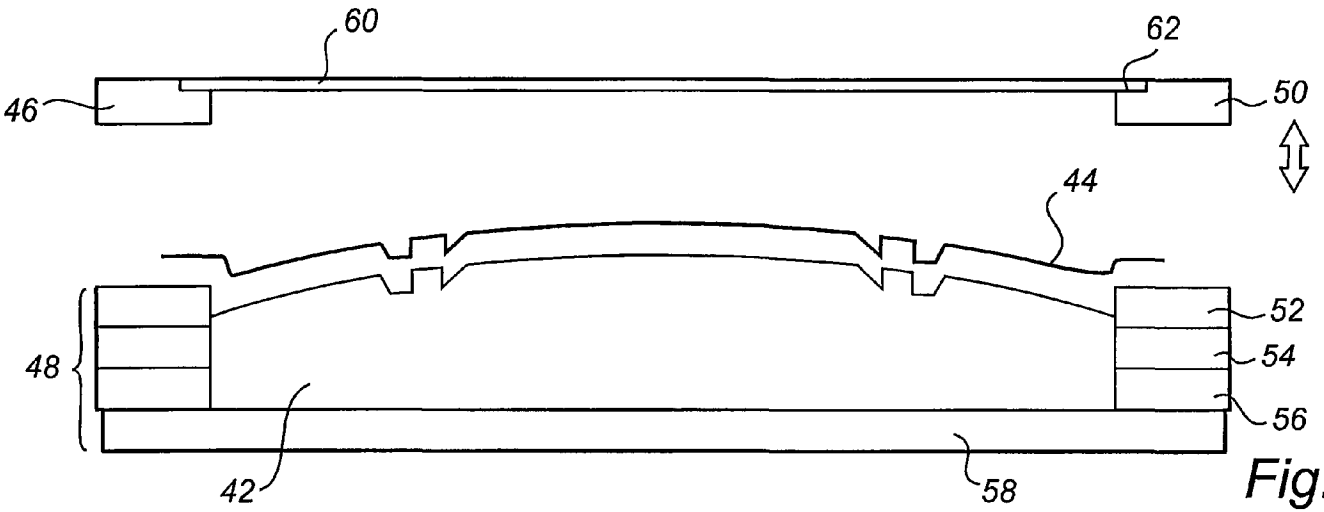
FIG. 3 shows the tray device in FIG. 2 in a divided configuration.

Thus, FIG. 3 illustrates how the upper tray part 46 has been lifted so that a space or air gap is formed between this part and the lower tray part 48, the formed metal sheet 44 thereby being uncovered and easily accessible. Suitably, a manipulator arm (not shown) is used to remove the metal sheet 44 and any scrap or excess material. After the cleaning, a new sheet metal blank to be formed can be arranged on the lower tray part 48. The upper tray part 46 is then lowered straight down so that the sheet is clamped between the two tray parts 46, 48. In the present example, the upper tray part 46 has been lifted straight up and will also be lowered straight down, i.e. without any horizontal displacement or rotation taking place. In the Figure, this vertical displacement of the tray device is indicated by a two-way arrow. It is also shown in FIG. 3 that the mat 60 intended to protect the diaphragm is moved together with the upper tray part 46 during separation, and, thus, no additional step is needed to move the mat out of the way.

Figure 4:
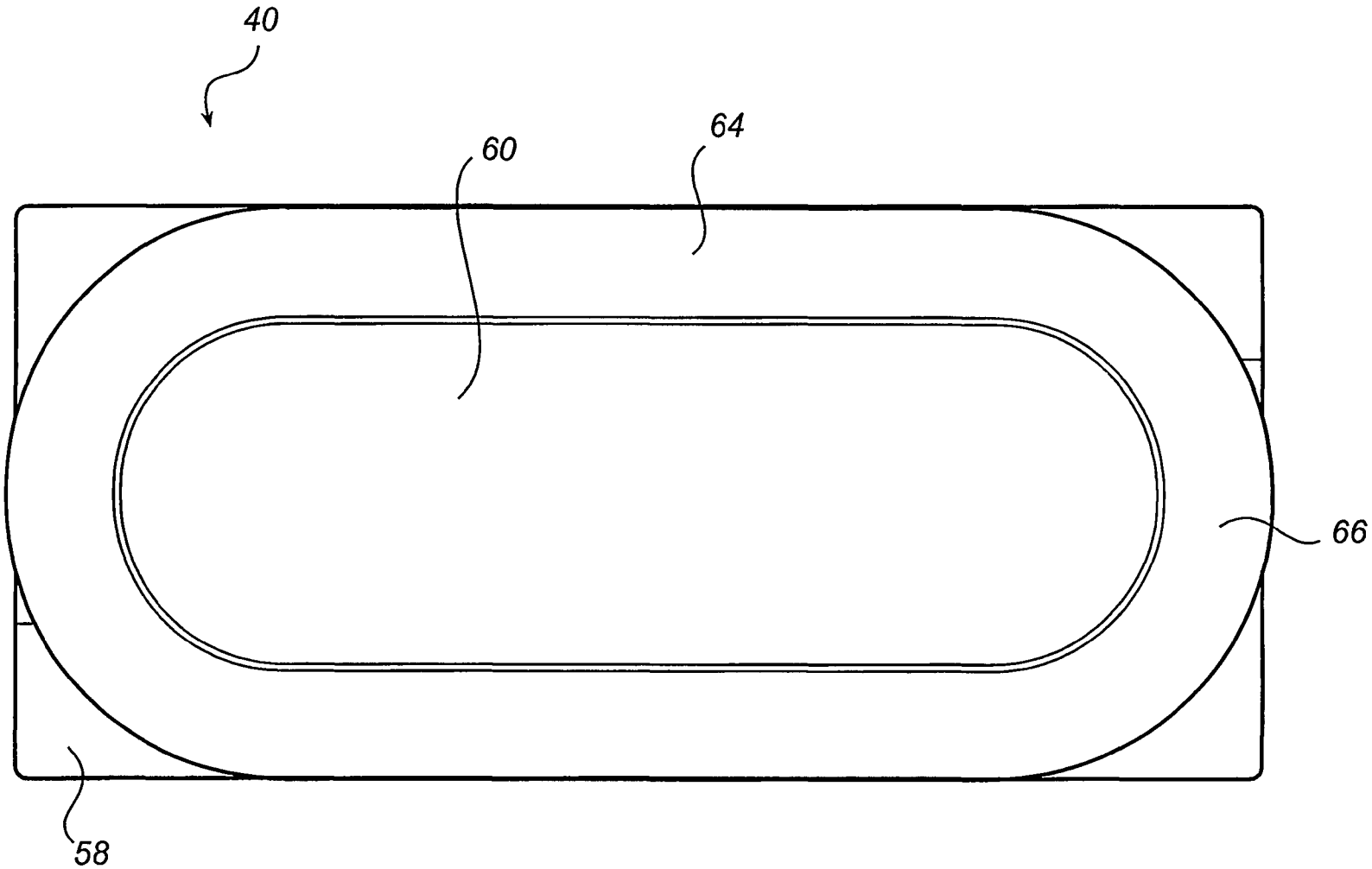
FIG. 4 is a top view of the tray device in FIG. 2.

FIG. 4 is a top view of the tray device 40 in FIG. 2. As shown in the Figure, the lamellar means included in the tray device 40 have essentially the shape of a 'running track', i.e. their wall is defined by two parallel straight portions 64 which at the ends are connected to one another by convex semicircles 66. The mat 60 intended to protect the diaphragm covers essentially all of the defined central space and, likewise, has the shape of a running track. Furthermore, it is shown that the tray plate 58, on which the lamellar means are arranged, is essentially quadrangular and that its length and width substantially correspond to the length and width of the lamellar means.

Figure 5:
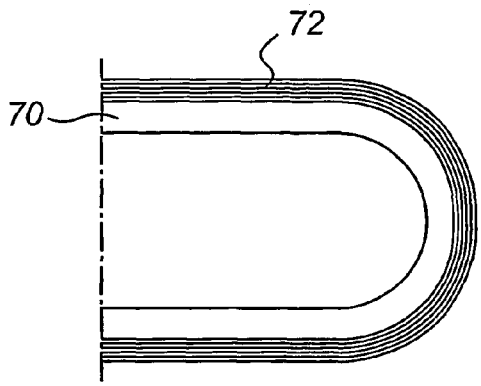
FIG. 5 is a part-sectional view of a tray frame along a plane parallel to the tray plane.

FIG. 5 is a part-sectional view of a tray frame 70 along a plane which is parallel to the tray plane. As shown in the Figure, the tray frame 70 is provided with a prestressing, preferably band-shaped winding 72 intended to absorb loads applied thereon during pressing. Thus, this force-absorbing winding 72 is not separate from the tray frame 70, but integrated therewith. The winding may be wound round the entire tray frame 70 or around one or more lamellar means of a tray device of, for example, the type shown in FIG. 2 and FIG. 3.

Figure 6:
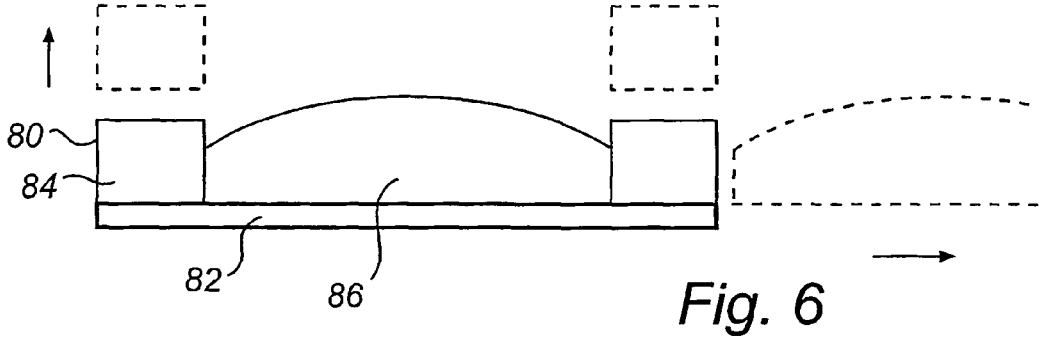
FIG. 6 is a side view in cross section of a tray device for use in a press plant according to another embodiment of the invention.

FIG. 6 is a schematic side view, in cross section, of a tray device 80 for use in a press plant with a press of pressure cell type according to another embodiment of the invention. The configuration that the tray device 80 has in the press chamber of the press of pressure cell type during a pressing operation is indicated by continuous lines. The tray device 80 thus comprises a tray plate 82 and a tray frame 84 detachably arranged thereon. The tray frame 84 is designed to independently withstand loads applied during the pressing operation, i.e. the tray frame 84 requires no external force-absorbing or supporting means. In the tray device 80, a forming tool 86 is arranged on the tray plate 82 for forming a workpiece (not shown). When changing the forming tool, the tray frame 84 is lifted and the forming tool 86 is then removed. This is indicated by dashed lines and arrows. A new forming tool is inserted before the tray frame 84 is lowered. In the case of wood compaction, the forming tool can be omitted, which means that the removal of the piece of wood that has been pressed is done in the same way as described above concerning the forming tool, which also applies to the insertion of a new piece of wood.

Figure 7:
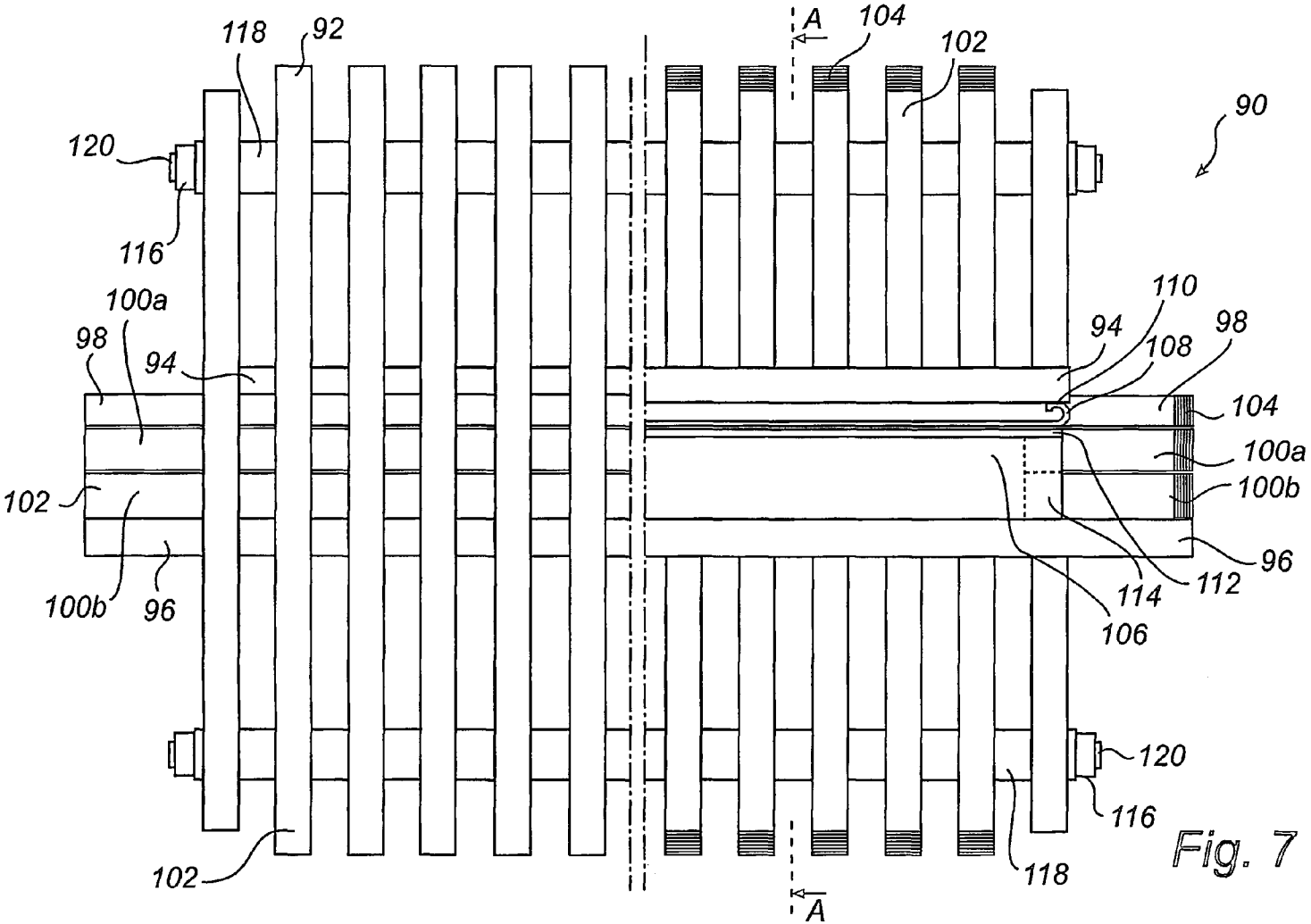
FIG. 7 is a side view, partly in cross section, of a press of pressure cell type for use in a press plant according to one embodiment of the present invention.

FIG. 7 is a side view, partly in cross section, of a press 90 of pressure cell type for use in a press plant according to one embodiment of the present invention. A central portion of the press 90 of pressure cell type is cut out of the Figure, to the left of the central portion an ordinary side view of the press being shown and to the right of the central portion a side view in cross section of the press being shown. The press 90 of pressure cell type is primarily made up of plate-shaped lamellar means. A force-absorbing press body is formed by vertically arranged, spaced-apart external lamellar means 92. Each external lamellar means 92 has a central hole, the press body thus enclosing a press chamber in which the actual pressing operation takes place. An upper press plate 94 and a bottom plate 96 run through the central holes of the external lamellar means 92. Between said plates, a diaphragm support 98 and two internal, horizontal lamellar means 100*a*, 100*b* are arranged in abutting contact with each other. Thus, the uppermost of said internal lamellar means 100*a* is contained in an upper frame part, as defined in the present application, and the lowermost of said internal lamellar means 100*b* is contained in a lower frame part, as defined in the present application. A metal sheet is intended to be arranged between said frame parts. The diaphragm support 98 is plate- and ring-shaped and, thus, has a shape that essentially corresponds to that of the internal lamellar means 100*a*, 100*b*. The lowermost, internal lamellar means 100*b* rests on the bottom plate 96 in a detachable manner, while the diaphragm support 98 is arranged in such manner that it partly encloses the press plate 94 (shown in the right part of the Figure) to ensure a satisfactory seal.

The circumference of the both the internal and the external lamellar means 92, 100*a*, 100*b* (including that of the diaphragm support 98) is defined by a relatively narrow, circumferential, external edge surface 102. A plurality of turns of a band 104 of spring steel are wound round the external edge surface 102 of the lamellar means 92, 100*a*, 100*b* and the diaphragm support 98, the band 104 having a width which essentially corresponds to the thickness of the lamellar means 92, 100*a*, 100*b* and the diaphragm support 98, respectively. The height of the layer of band 104 wound round the lamellar means 92, 100*a*, 100*b* and the diaphragm support 98 is about 100 mm and the layer can consist of one single long band or several joined bands. When a lamellar means 92, 100*a*, 100*b* is being manufactured, the band 104 is wound round the same during resistance so that a compressive prestress is permanently induced in the lamellar means 92, 100*a*, 100*b*. As shown in FIG. 1, the tray device according to the invention, i.e. the internal lamellar means 100*a*, 100*b*, does not have any external support at the short sides of the press 90 of pressure cell type, since this function is provided by the winding 104 in a satisfactory manner. For the same reason, the diaphragm support 98 is not provided with any external support either.

As already mentioned, the right part of FIG. 7 is a side view in cross section of the press 90 of pressure cell type. The cross section is made at the centre of the press, i.e. along the main axis of the press chamber. The right part of FIG. 7 clearly shows that both the lamellar means 92, 100*a*, 100*b* and the diaphragm support 98 are wound with a band 104 on the respective external edge surfaces 102. According to the invention, this band winding 104 of the internal lamellar means 100*a*, 100*b* forming a tray device and the diaphragm support 98 is intended to essentially permanently limit expansion thereof, i.e. they must be able to withstand the forces which are generated in the press chamber. The internal lamellar means 100*a*, 100*b* are annular, which thus means that they define an internal, open space 106 which is comprised in the press chamber. A diaphragm 108 is arranged in the open space of the diaphragm support 98. The diaphragm 108 has a seal 110 against the press plate 94 and forms a pressure cell therewith. During operation, a pressure medium is supplied to the pressure cell in such a manner that the diaphragm 108 expands. The open space 106 of the lower internal lamellar means 100*a*, 100*b* arranged below the diaphragm support 98 is intended to contain a forming or working tool. A metal sheet which is to be pressed against the working tool is suitably arranged above the working tool, as clamped between the internal lamellar means 100*a*, 100*b*, the diaphragm 108, when pressurised, expanding and being formed on the working tool, which means that the metal sheet located therebetween is also formed on the working tool. Besides, the Figure shows that a mat 112 is arranged just below the diaphragm 108. The mat 112 takes part in the forming of the plate and at the same time protects the diaphragm 108 against wear.

Adjacent to the internal wall of the lower internal lamellar means 100*a*, filling elements 114 (indicated by dashed lines) of rubber can be arranged, if desirable, with the aim of distributing forces and supporting the working tool or a piece of wood to be pressed. A piece of wood can be arranged and pressed either directly against the bottom plate 96 or against a working tool arranged on the bottom plate 96.

Apart from the central hole, the external lamellar means 92 are each formed with four circular apertures, two above and two below the hole. The apertures are intended to receive coupling means. Through the circular apertures of all lamellar means included in the press body run coupling means 116 (two of which are shown), for example a steel rod having threaded ends. The lamellar means 92 constituting the press body are kept at a distance from one another by the fact that round each coupling means 116, between the lamellar means 92, there are distance means 118 having a thickness that is as large as the desired distance between the lamellar means. The distance means 118 are made of a relatively rigid material and their inner diameter is larger than that of the coupling means 116 at the same time as their external dimensions are essentially larger than the apertures arranged in the lamellar means 92. At the two external ends of the coupling means 116, outside the respective external lamellar means 92 which are included in the press body, there are stop devices 120 of which at least one has a fixing and clamping mechanism which is complementary to the coupling means 116. In the case when the coupling means comprises a rod being threaded at its ends, the fixing and clamping mechanism may comprise a washer and a nut, the washer having external dimensions which are essentially larger than the coupling apertures of the external lamellar means. The four coupling means 116 are thus tightened to a predetermined prestress condition. This eliminates play and motion in the construction and at the same time contributes to the structural stability of the construction as regards flexural rigidity, torsional rigidity and resistance to extension in all dimensions.

Figures 8A, 8B:
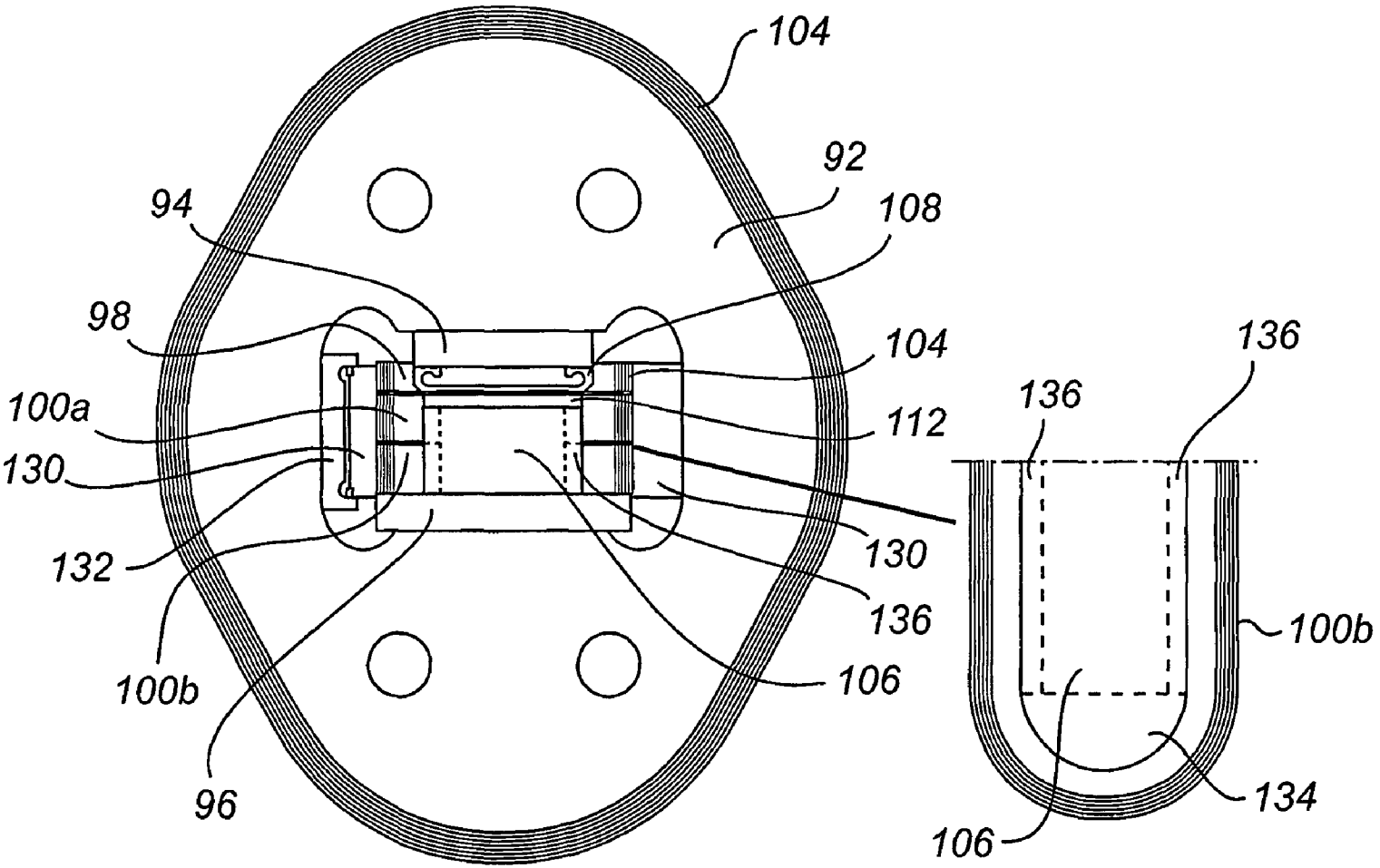
FIG. 8A is a cross-sectional view of the press of pressure cell type along the line A-A in FIG. 7.
FIG. 8B is a top view of a detail in FIG. 8A.

FIG. 8A is a cross-sectional view of the press of pressure cell type along the line A-A in FIG. 7. The Figure shows that one external lamellar means 92 is plate-shaped. The central through hole of the external lamellar means 92 is defined by an internal edge surface. The hole is essentially quadrangular, but without actual corners. The "corner regions" are instead rounded and bend inwards into the wall so that a larger hole area is obtained. The radii of these inward bends are made relatively large with the aim of minimising the stress concentration that arises in the corner regions.

The external lamellar means 92 is essentially quadrangular and has rounded corners. The shape of the lamellar means 92 is adapted to the expected thrust which arises in connection with the pressing. Thus, the material quantity or the distance between the internal and the external edge surface is larger vertically than horizontally since the main direction of pressing is vertical.

A plurality of turns of a band 104 of spring steel are wound round the external edge surface of the external lamellar means 92, the internal lamellar means 100*a*, 100*b* and the diaphragm support 98 shown in FIG. 8A, the band 104 having a width which essentially corresponds to the thickness of the respective lamellar means 92, 100*a*, 100*b* (or of the diaphragm support 98). The layer can consist of a single long band or several joined bands.

FIG. 8A also shows side walls 130 arranged on either side of the internal lamellar means 100*a*, 100*b* and the diaphragm support 98 and extending in the direction of the main axis of the press chamber. The side walls 130 have a height which essentially corresponds to the distance between the upper press plate 94 and the bottom plate 96. The internal lamellar means 100*a*, 100*b* and the diaphragm support 98 are during pressing exposed to an internal overpressure, and because of this fact the lamellar means aim at expanding, whereby high tensile stress in the internal periphery of the internal lamellar means is generated. For this reason, a hydraulic compensator or generator 132 of horizontal force is arranged adjacent to the left side wall 130 in the Figure. This generator affects the internal lamellar means 100*a*, 100*b* and the diaphragm support 98 horizontally and predeforms and prestresses the deformation zones thereof. Unlike the integrated wound bands 104, this generator 132 is separate from the internal lamellar means 100*a*, 100*b* forming the tray device and the diaphragm support 98, and is adapted to apply these radially prestressing or predeforming forces. Conveniently, the generator comprises hydraulic pistons.

FIG. 8B is a partial top view of the lower internal lamellar means 100*b* in FIG. 8A. Thus, it is shown that this lamellar means 100*b* has the form of a "running track", i.e. its wall is defined by two parallel straight portions which at the ends are connected to one another by convex semicircles. In the space just inside the respective semicircles, a semi-circular filling block or end block 134 (indicated by dashed lines) of resilient material, such as rubber, is fitted so that the remaining free space is quadrangular. The purpose of the end blocks 134 is to serve as support for the working tool. Straight resilient supports 136 (indicated by dashed lines) which are parallel to the direction of the main axis of the press chamber can also be arranged adjacent to the straight wall portions. These supports 136 and end blocks 134 (which correspond to the filling element 114 in FIG. 1) also have a protecting function in the sense of protecting and prolonging the service length of the internal lamellar means 100*a*, 100*b*. Since the internal lamellar means 100*a*, 100*b* are prestressed by the turns of the band 104, no external limiting means are required and therefore, for example, the semi-circular portions can protrude from the ends of the press body as shown in FIG. 7. Since the internal lamellar means 100*a*, 100*b* forming the tray device protrude, they are relatively easily accessible, which is time-saving when metal sheets are removed, tools are replaced, diaphragms are replaced etc.

FIGS. 9A-9E are end views of some variants of presses of pressure cell type according to the invention. It thus appears from the Figures that the size of both the external press body and the inner press chamber comprising the tray device may vary. The tray device may be formed of a varying number of internal lamellar means, and the thickness of these lamellar means may vary.

Figure 9A:
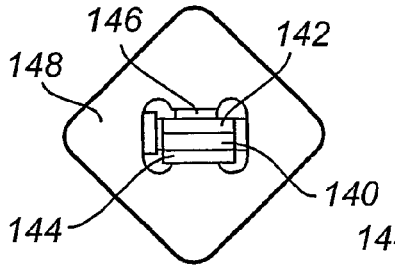
FIGS. 9A-9E are end views of variants of presses of pressure cell type according to the invention.
Figure 9B:
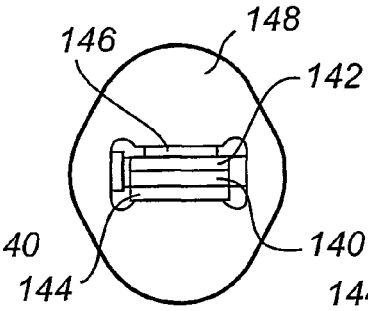
Figure 9C:
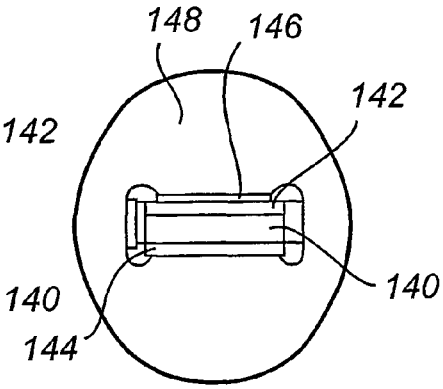

FIGS. 9A-9C illustrate some variants, in which an internal lamellar means 140 is arranged between a diaphragm support 142 and a bottom plate 144. A press plate 146 is arranged above the diaphragm support. An external lamellar means 148 forming a press body can thus be provided in different shapes and sizes. The size of the internal lamellar means 140 can also be varied. In FIG. 9A, the dimensions of the load space are 100×200×2500 $mm^3$ and the tray device is adapted for a typical working pressure of 1200 bars. In FIGS. 9B and 9C, the dimensions of the load space are respectively 125×500×1500 $mm^3$ and 200×710×2000 $mm^3$.

Figure 9D:
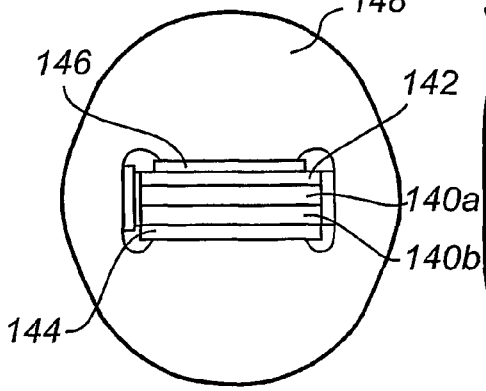

FIG. 9D illustrates a variant having a tray device which comprises two lamellar means 140*a*, 140*b* which are arranged between the diaphragm support 142 and the bottom plate 144. The dimensions of the load space are 200×1100×2000 $mm^3$.

Figure 9E:
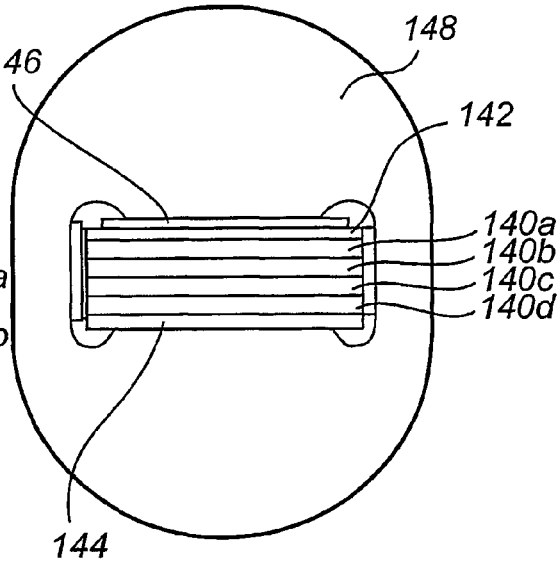

FIG. 9E illustrates a variant having a tray device which comprises four lamellar means 140*a*, 140*b*, 140*c*, 140*d* which are arranged between the diaphragm support 142 and the bottom plate 144. The dimensions of the load space are 400×1600×4000 $mm^3$.

Figure 10A:
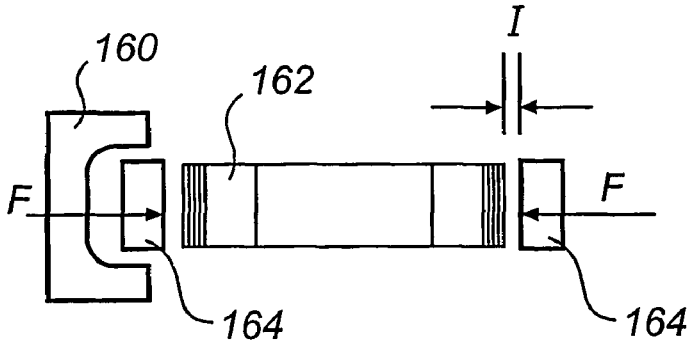
FIGS. 10A-10C illustrate the function of a standalone force generator.
Figure 10B:
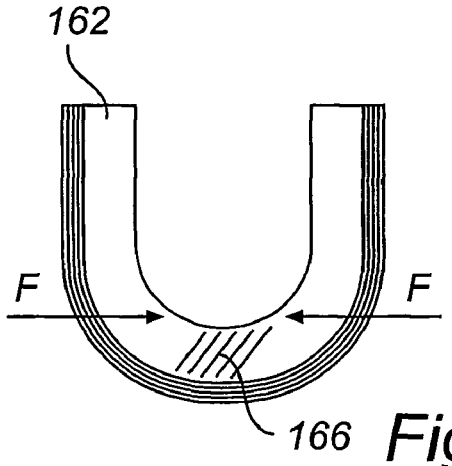
Figure 10C:
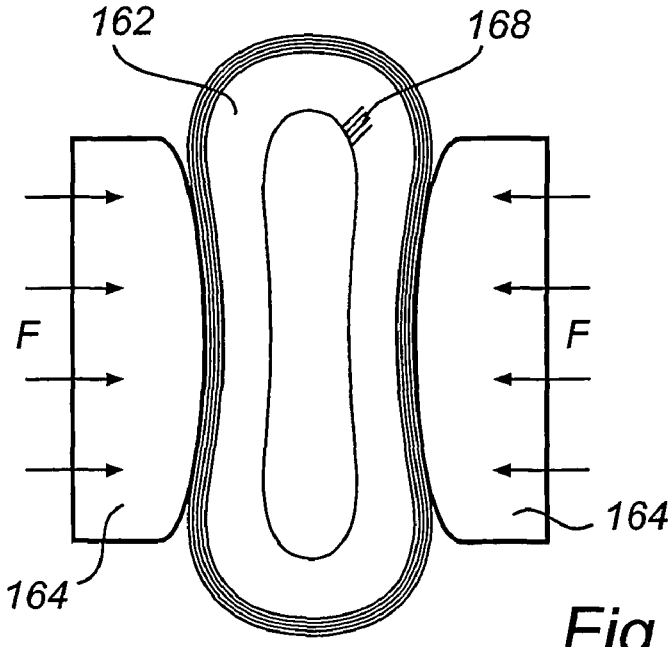

FIGS. 10A-10C illustrate the function of a stand-alone force generator 160. During a pressing operation, an essentially oval tray device 162 (or lamellar means included in the tray device) according to the invention is exposed to an internal overpressure. High tensile stress is generated in the internal periphery of the tray device. It may therefore be desirable, inter alia, to control any possible deformations. The applied generator 160 generating a force F in the horizontal direction eliminates any initial play between the tray device 162 and the side wall 164, as illustrated schematically in FIG. 10A, which is a cross-sectional view similar to FIG. 8A.

FIG. 10B is a partial top view, similar to FIG. 8B, of a lamellar means or a tray device 162. Stress concentrations may arise during pressing operations in the front portion or tip 166 of the tray device 162 due to peeling. The generator of the horizontal force F generates compressive stress in the tip 166 which reduces or eliminates the peeling.

FIG. 10C is a top view of a lamellar means or a tray device 162 and side walls 164. In the transition zones 168 between the straight long sides of the tray device 162 and the two semicircular wall portions, stress concentrations may arise. By predeforming the tray device 162, compressive stress is generated in the transition or deformation zones 168. As illustrated in the Figure, the transition zones 168 are excessively bent to reduce the tensile stress.

Although some preferred embodiments have been described above, the invention is not limited thereto. The design of the individual lamellar means and the diaphragm support can, for instance, be varied in accordance with the current needs. It should thus be understood that a plurality of modifications and variations can be provided without deviating from the scope of the present invention which is defined in the appended claims.

The invention claimed is:

1. A press plant, comprising:

a pressure cell-type press adapted for sheet metal forming, the press including a force-absorbing press body enclosing a press chamber; and a tray device configured to be positioned within the press chamber, the tray device being adapted to hold a forming tool and defining a space to receive a workpiece, said tray device comprising a tray plate and a tray frame, the tray frame being adapted to independently withstand loads applied during a pressing operation, the tray device being divisible into at least an annular upper part and a lower part.

2. The press plant as claimed in claim 1, wherein the tray frame is adapted to independently withstand loads applied during the pressing operation along the direction of a main axis of the press chamber.

3. The press plant as claimed in claim 1, wherein the tray frame is annularly divisible into at least an upper frame part and a lower frame part for insertion into the tray device and removal therefrom of a workpiece.

4. The press plant as claimed in claim 3, wherein the tray frame is arranged such that a workpiece inserted into the tray device is retained in a fixed position when the upper and lower frame parts have been joined to form the tray frame.

5. The press plant as claimed in claim 4, wherein the tray frame is adapted to retain the workpiece in a fixed position between the upper and lower frame parts.

6. The press plant as claimed in claim 1, wherein the tray frame is annularly detachable from the tray plate for insertion into the tray device and removal therefrom of a workpiece.

7. The press plant as claimed in claim 1, wherein prestressing means for inducing a compressing prestress acting in planes parallel to the tray plate are arranged on an external surface of the tray frame.

8. The press plant as claimed in claim 7, wherein said prestressing means comprise at least one prestressing element wound round an external surface of the tray frame.

9. The press plant as claimed in claim 3, wherein each frame part comprises at least one annular plate so that the tray device comprises at least two concentric annular plates abutting against one another, each having a centrally located through hole and being located in planes which are parallel to the tray plate, each plate being provided with a prestressing element, said prestressing element being band-shaped and having essentially the same width as a thickness of the respective plate.

10. The press plant as claimed in claim 3, wherein actuating means are adapted to exert a force on at least one of the upper and lower frame parts to allow access to a workpiece inserted into the tray device for removal thereof and to allow a workpiece to be inserted into the tray device.

11. The press plant as claimed in claim 10, wherein said actuating means are adapted to exert a force on at least one of the upper and lower frame parts along the direction of their common center axis to create a space between the upper and lower frame parts, a height of which is related to an extension of a finished workpiece along the direction of said center axis.

12. The press plant as claimed in claim 11, wherein said actuating means are located adjacent to a worktable outside the press chamber and adapted to exert a lifting force on the upper frame part when the tray device is placed on the worktable.

13. The press plant as claimed in claim 12, wherein contact means configured to co-operate with said actuating means project from an external edge surface of the upper tray part, said contact means comprising engagement surfaces and said actuating means acting on the contact means from underneath.

14. The press plant as claimed in claim 3, wherein a resilient mat is arranged adjacent to the upper frame part, the mat accompanying the upper frame part as this is removed from the lower tray part, thereby uncovering the workpiece.

15. The press plant as claimed in claim 1, wherein the press plant is configured for high-pressure pressing.

16. The press plant as claimed in claim 1, wherein the annular upper part surrounds the space.

17. A tray device for use in a press plant having a press, the tray device comprising:

an annular upper part; and a lower part;

the tray device being configured to hold a sheet metal forming tool, and to independently withstand loads applied during a pressing operation, wherein the annular upper part and the lower part are divisible.

18. The tray device as claimed in claim 17, wherein the tray device is adapted to independently withstand loads applied during the pressing operation along the direction of the main axis of the press chamber.

19. The tray device as claimed in claim 17, wherein the upper part comprises a tray frame and the lower part comprises a tray plate, and wherein the tray frame is configured to be separated from the tray plate for insertion therein and removal therefrom of a workpiece.

20. The tray device as claimed in claim 17, wherein the annular upper part surrounds a space intended to receive a workpiece.

21. A press plant with a press, comprising:

a pressure cell-type press adapted for sheet metal forming, the press comprising a force-absorbing press body enclosing a press chamber; and a tray device configured to be positioned within the press chamber, the tray device defining being adapted to hold a forming tool, and defining a space to receive a workpiece, said tray device comprising a tray plate and a tray frame, the tray frame being adapted to independently withstand loads applied during a pressing operation, the tray device being divisible into at least an annular upper part having at least one arcuate portion and a lower part.

22. The press plant as claimed in claim 21, wherein the annular part surrounds the space.

23. A tray device for use in a press plant having a press of pressure cell type, the tray device comprising:

an annular upper part having at least one arcuate portion; and a lower part;

the tray device being configured to hold a sheet metal forming tool and independently withstand loads applied during a pressing operation, wherein the annular upper part and the lower part are divisible.

24. The tray device as claimed in claim 23, wherein the annular upper part surrounds a space intended to receive a workpiece.

* * * * *